US006805529B2

(12) United States Patent
Liu

(10) Patent No.: US 6,805,529 B2
(45) Date of Patent: Oct. 19, 2004

(54) ASSEMBLY OF COMPLEX MECHANICAL SEAL FOR VERTICAL MULTIPLE STAGE PUMP

(75) Inventor: Ming-Tsung Liu, Taichung (TW)

(73) Assignee: Reliance Pumps Co., Ltd., Taichung (TW)

( * ) Notice: Subject to any disclaimer, the term of this patent is extended or adjusted under 35 U.S.C. 154(b) by 0 days.

(21) Appl. No.: 10/245,472

(22) Filed: Sep. 17, 2002

(65) Prior Publication Data

US 2003/0194316 A1 Oct. 16, 2003

(30) Foreign Application Priority Data

Apr. 15, 2002 (CN) ..... 02 2 31101 U

(51) Int. Cl.[7] ..... F16J 15/00
(52) U.S. Cl. ..... 415/111; 415/230
(58) Field of Search ..... 415/230, 231, 415/111, 112, 113, 174.2, 199.1, 199.2, 199.3

(56) References Cited

U.S. PATENT DOCUMENTS 6,126,388 A * 10/2000 Yamanaka et al. ..... 415/111

* cited by examiner

*Primary Examiner*—Edward K. Look
*Assistant Examiner*—Kimya N. McCoy
(74) *Attorney, Agent, or Firm*—McGlew and Tuttle, P.C.

(57) ABSTRACT

A complex mechanical seal for vertical multiple stage pump includes a hollow cylinder fixed plate positioned in the vertical multiple stage pump. It is coupled to a fixed barrel. The bottom hole of fixed barrel is used as the passage of pump axle. A long axle bushing in the inner part of the fixed plate is fixed on the pump axle. A balance plate is positioned below long axle bushing. The circumference of balance plate has a flange. The mechanical seal is fixed on the upper space of the balance plate and fixed on long axle bushing. A return water passage is connected to the upper part of balance plate and to inlet of pump, and the high pressure region. A and low pressure region B, are needed as the pushing force. The complex structure of balance plate and mechanical seal is simultaneously easier and quicker to assemble and disassemble.

9 Claims, 2 Drawing Sheets

ASSEMBLY OF COMPLEX MECHANICAL SEAL FOR VERTICAL MULTIPLE STAGE PUMP

FIELD OF THE INVENTION

The present invention relates to an assembly of complex mechanical seals for a vertical multiple stage pump. More particularly, the invention relates to a cassette type assembly of complex mechanical seals comprised of a balance plate and a mechanical seal. Specifically, the invention relates to replacing the balance plate and mechanical seal more easily so as to guarantee the efficacy of the pump.

BACKGROUND OF THE INVENTION

There are several ways to overcome the problem of force being applied horizontally against a vertical multiple stage pump. For instance, one could use bearing directly against the horizontally pushing force, or use a balance holes, or use balancing dice. However, in general, a balance plate is usually adapted to solve the horizontal force problem.

When the balance plate is used as a balance apparatus for a vertical multiple stage pump, the main structure of mechanical seal is arranged on the upper part of the pump.

Thus the position of the mechanical seal provides for a leaking out gate in order to prevent the gas from being trapped on the upper part of the pump. This allows the mechanical seal to stay cool and stay lubricated by the use of movable liquid, so as to seal the pump and the stabilizing work.

In addition, in the conventional balance apparatus, the gas between the balance plate and fixed element will increase the amount of gas leakage due to the decrease of gas pressure thus lowering the efficacy of the pump.

Further, the size of the balance plate is to close too the inlet size of the blade wheel and it is an independent apparatus.

Thus, the vertical and the horizontal size require a certain space to satisfy the requirement of the operation as mentioned.

Therefore, the maintenance work of assembling and disassembling of such an apparatus is very difficult because it takes a long time to disassemble and assemble the mechanical seal and balance plate.

SUMMARY OF TIE INVENTION

The inventor discovered the balance apparatus of the conventional pump is accompanied with the above mentioned defects. To overcome such defects, a cassette complex structure for a novel mechanical seal and balance plate is provided.

In addition to quickly executing the assembling and disassembling of the apparatus, the present invention maintains the efficacy of the pump so as not to be influenced by the changing of pressure, which is the main object of the present invention.

According to the present invention, the mechanical seal and balance plate are combined together. Thus the whole structure is more closely and firmly packed and provides a space saving, which is the further object of the present invention.

The present invention provides a complex mechanical seal for a vertical multiple stage pump, which comprises: a hollow cylinder fixed plate positioned in the final stage of outlet gate in the vertical multiple stage pump. It is coupled with an inner wall surface of fixed barrel is to form a sealed face. The bottom hole of the fixed barrel is used as the passage for the pump axle. A long axle bushing in the inner pant of the fixed plate is fixed on the pump axle.

A balance plate is positioned below a long axle bushing and combined with the long axle bushing to become part of it. The circumference of the balance plate has a promotion flange to divide the inner wall surface and to form a gap. The mechanical seal is fixed on the upper region of the balance plate and fixed on the long axle bushing.

A return water passageway is connected to the upper part of the balance plate and is also connected to the inlet of the pump, within the fixed plate, and the high pressure region A high pressure region A and a low pressure region B are formed at the lower part and the upper part respectively. These differential pressure forces are need as the pushing force of the balance axle.

Simultaneously, the complex structure of the balance plate and mechanical seal is accomplished more easily and quickly in assembly and disassembly.

According to the present invention, the mechanical seal and balance plate are combined together, and the circumference of balance plate is to form various annular grooves.

Said combined structure is able to keep a small distance with the inner face of the circumference of the fixed barrel.

Thus the combination of balance plate and axle is to keep a same gap distance from the inner face doing rotation and change of pressure.

The amount of leaking out is not influenced to keep unchanged so as to maintain the efficacy of the pump, In addition, according to the present invention, the combined mechanical seal and balance plate are disassembled and assembled together from a pump axle. Therefore, the work of disassembling and assembling are easier and maintenance is easier as well.

According to the present invention, the complex structure of mechanical seal and balance plate is to form an outlet pipe line connected to the inlet. Thus when the pump starts to operate, it is able to provide air to the outlet automatically. This is another object of the present invention.

The present invention will be apparent in its novelty and features after reading the detailed description of the preferred embodiment thereof in reference to the accompanying drawings.

DESCRIPTION OF THE PREFERRED EMBODIMENT

Figure 1:
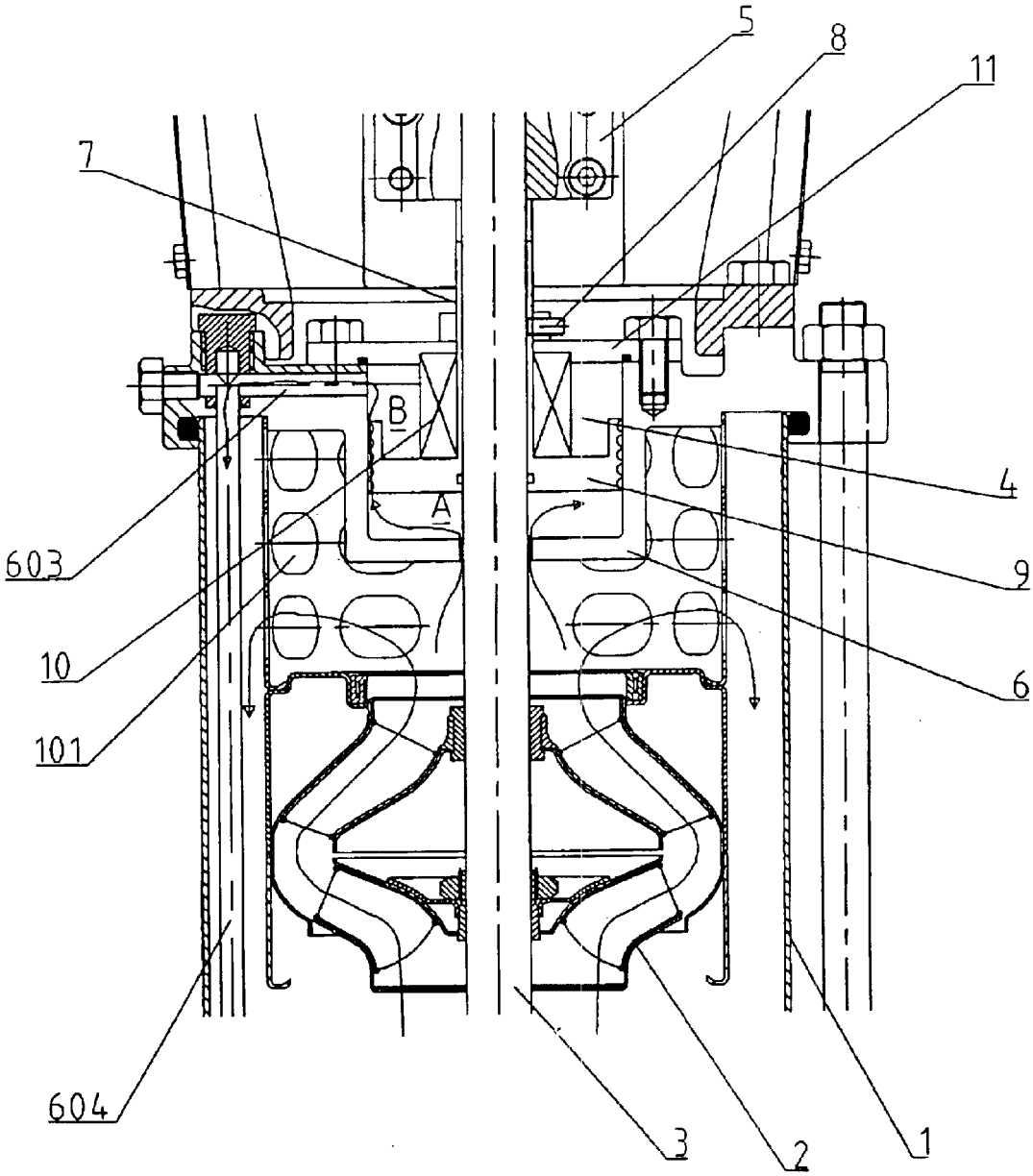
FIG. 1 is a schematic view showing the complex structure of mechanical seal and balance plate of the present invention to be arranged on the upper part of the last blade wheel within the vertical multiple stage pump, in which the conventional elements are omitted.

First, referring to FIG. 1, a housing 1 within a vertical multiple stage pump is located in an outlet region of the upper part of the last blade wheel 2.

The assembly of the complex mechanical seal 4 of the present invention is arranged on pump axle 3. As used in the conventional method, the pump axle 3 via coupling 5 is rotated by a motor (not shown).

Figure 2:
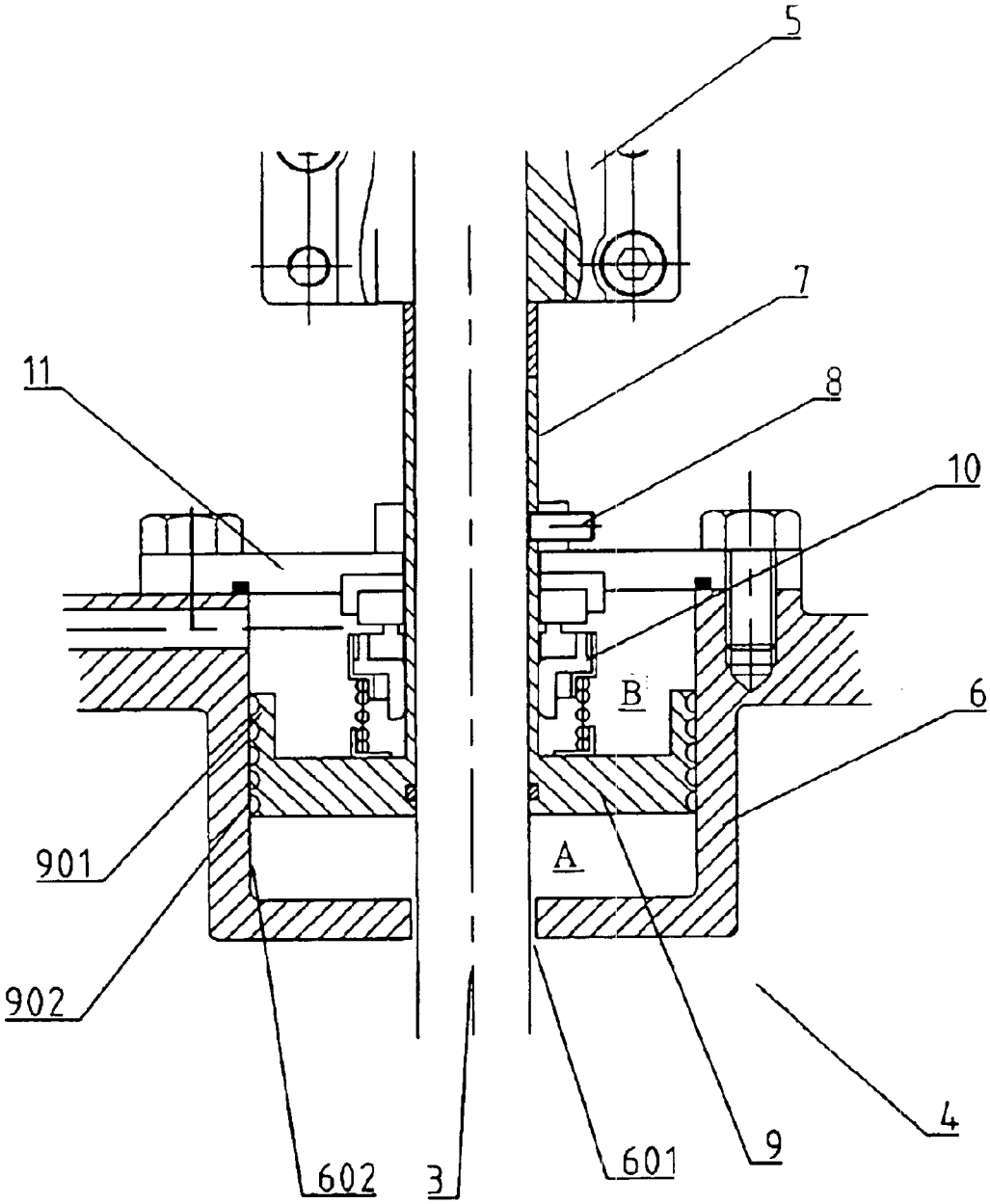
FIG. 2 is an enlarged view showing the complex structure of mechanical seal and balance plate in the FIG. 1 of the present invention.

Referring to FIGS. 1 and 2, the assembly of the complex mechanical seal 4 is arranged in the inner part of the mechanical seal house of the fixed barrel 6, including a hollow cylinder fixed barrel 6 arranged on the top of housing 1.

It is used to form two of upper and lower balance houses and the pump axle 3 passed through the bottom hole 601 of fixed barrel 6.

Inside the fixed barrel 6, a set of long axle bushings 7 along the pump axle 3 is screwed with a bolt 8 along the pump axle 3 and is rotatable with the pump axle 3.

A balance plate 9 is formed under the long axle bushing 7, which forms a predetermined gap around the arising flange 901 of the circumference of the balance plate 9 and the inner wall surface 602 of the fixed barrel 6.

Further, the circumference of the flange 901 forms plural annular grooves 902. Thus the balance plate 9 in the inner space of the fixed barrel 6 forms a high pressure region A under the lower part of the balance 9.

The balance plate 9 in the inner space of the fixed barrel 6 also forms a low pressure region B on the upper part of the balance plate 9.

On the top part of the balance plate 9, the long axle bushing 7 fixes a conventional mechanical seal 10 to combine with the balance plate 9 together.

Via an axle sealed gland 11, the low pressure region B is covered, and the low pressure region B is connected to the inlet gate via return water passages 603 and 604.

According to the present invention, when the multiple stage pump starts to rotate, the air in the low pressure region B is able to be outflow automatically via the return passages 603 and 604 due to the rotation of balance barrel 9 and mechanical seal 10.

Thus there is no need to do the manual operation as done in the conventional case.

Simultaneously, as the low pressure region B is connected to the inlet gate of the pump, it is able to keep the low pressure state.

Therefore, the high pressure water outflows mostly via the last stage of the pump which is at outlet gate (drain port) 101. The high pressure water then flows to an outlet from the housing 1.

Another portion of the high pressure water acts on the balance plate 9 via the bottom hole 601. This portion of the high pressure water takes advantage of the differential pressure to form an arising pushing force to act on the balance plate 9.

This arising pushing force acts to counter balance the resultant force formed by the down forward vertical pushing force of the blade wheel and the gravity of blade wheel of the pump and so on.

Taking advantage of the present invention, when the pressure of the high pressure water to the outlet arises, due to the gap of the flange 901 in the balance plate 9 and the inner wall surface 602 of the fixed barrel 6 is kept unchanged. Thus, the design of the multiple annual groove is able to buffer the flowing of water stream.

Therefore, the amount of high pressure leakage of the pump which enters into the balance region can be kept at a certain rate and can also be used to cool and lubricate the mechanical seal 10, so as to keep the efficacy of pump.

Further, taking advantage of the present invention, the balance plate 9 and mechanical seal 10 are combined together to form a complex structure.

Thus, as shown in FIGS. 1 and 2, to maintain and repair the apparatus, an operator would only dissemble the mechanical seal gland 11, i.e. to take down the complex structure from the pump axle 3. Thus, the maintenance and repair operation become much easier and quicker.

The feature and preferred embodiments of the prevent invention have been described in foregoing specification and the explanation of vertical multiple stage pump is done.

The invention is also suitable for the pushing force of other kind of pump. Variations and changes which may be made by those skilled in the art are without departing from the scope of the present invention.

Lists of Symbol

1 housing
2 blade wheel
3 pump axle
4 assembly of complex mechanical seal
5 coupling
6 fixed barrel
7 long axle bushing
8 bolt
9 balance plate
10 mechanical seal
11 gland
101 outlet gate (drain port)
601 bottom hole
602 inner wall surface
603,604 return water passage
901 flange
902 annual groove
A high pressure region
B low pressure region

What is claimed is:

1. A complex mechanical seal for vertical multiple stage pump having the balance effect of the vertical pushing force, comprising:

a fixed plate positioned in the vertical multiple stage pump further comprising:

a mechanical seal region formed in the inner wall, and having a bottom hole for the passage of a pump axle;

a hollow cylinder fixed plate formed by a long axle bushing of the fixed pump axle; and a balance plate becoming one part assembly, the circumference of said balance plate having a promotion flange;

a sliding sealed surface formed by the surface and the inner wall surface to be coupled to form a gap, to divide mechanical seal house into a high pressure region formed at the lower part and a low pressure region formed at the upper part;

a mechanical seal fixed on the long axle bushing of the fixed plate whereby to block the leakage of transporting liquid, and a return water passage positioned on the low pressure region of the upper part of the balance plate so that the high pressure region of the lower part of balance plate to form the pushing force whereby to balance the resultant force by down forward vertical pushing force of the blade wheel.

2. A complex mechanical seal for vertical multiple stage pump according to claim 1, wherein the circumference of the flange of balance plate being formed plural annual grooves.

3. A complex mechanical seal for vertical multiple stage pump according to claim 1, wherein a return water passageway is connected to the upper part of balance plate and connected to inlet of pump.

4. A complex mechanical seal for vertical multiple stage pump according to claim 1, wherein the return water passage arranged on the inner part of pump housing to be returned to the inlet gate of pump.

5. An easily accessible mechanical seal on top of a vertical axle of a multiple stage pump which counterbalances vertical force pushing liquid downward by a bladewheel secured around the lower portion of the vertical axle, the mechanical seal comprising:

a barrel-shaped sealing base including an inner and outer surface with a center hole secured around the intermediate portion of the vertical axle;

an axle bushing with a top and bottom distal ends secured around the upper portion of the vertical pump axle;

a middle balance plate with a center hole coupled to bottom distal end of said axle bushing and an outer edge contacting said inner surface of said barrel-shaped sealing base, said middle balance plate defining a high pressure space between said middle balance plate and said barrel-shaped sealing base;

a gland sealing top with a center hole secured around the intermediate portion of said axle bushing on top of said barrel-shaped sealing base, said gland sealing top defining a low pressure space between said gland sealing top ad said middle balance plate;

a mechanical seal coupled around said axle bushing under said gland sealing top and above said middle balance plate;

a liquid return passageway from said low pressure space, said liquid return passageway defined by one of said barrel-shaped sealing base and said gland sealing top.

6. An easily accessible mechanical seal according to claim 5, wherein said outer edge of said middle balance plate further comprises plural annular grooves.

7. An easily accessible mechanical seal according to claim 5, wherein said liquid return passageway is coupled to an inlet of the multiple stage pump.

8. An easily accessible mechanical seal according to claim 5, wherein said liquid return passageway is arranged inside the multiple stage pump and coupled to an inlet of the multiple stage pump.

9. A method for easily accessing a mechanical seal on top of a vertical axle of a multiple stage pump which counterbalances vertical force pushing liquid downward by a bladewheel secured around the lower portion of the vertical axle, the method comprising:

providing a barrel-shaped sealing base including an inner and outer surface with a center hole secured around the intermediate portion of the vertical axle;

providing an axle bushing with a top and bottom distal ends secured around the upper portion of the vertical pump axle;

providing a middle balance plate with a center hole coupled to bottom distal end of said axle bushing and an outer edge contacting said inner surface of said barrel-shaped sealing base, said middle balance plate defining a high pressure space between said middle balance plate and said barrel-shaped sealing base;

providing a gland sealing top with a center hole secured around the intermediate portion of said axle bushing on top of said barrel-shaped sealing base, said gland sealing top defining a low pressure space between said gland sealing top and said middle balance plate;

providing a mechanical seal coupled around said axle bushing under said gland sealing top and above said middle balance plate;

providing a liquid return passageway from said low pressure space, said liquid return passageway defined by one of said barrel-shaped sealing base and said gland sealing top;

removing said gland sealing top;

removing said middle balance plate for maintenance or repair;

replacing said middle balance plate; and replacing said gland sealing top.

* * * * *